US009046088B2

(12) United States Patent
Clarke

(10) Patent No.: US 9,046,088 B2
(45) Date of Patent: Jun. 2, 2015

(54) METHOD AND APPARATUS FOR HEATING A SALES TANK

(75) Inventor: Kevin Clarke, Two Hills (CA)

(73) Assignee: Newco Tank Corp., Two Hills (CA)

( * ) Notice: Subject to any disclaimer, the term of this patent is extended or adjusted under 35 U.S.C. 154(b) by 413 days.

(21) Appl. No.: 13/481,527

(22) Filed: May 25, 2012

(65) Prior Publication Data

US 2012/0301332 A1 Nov. 29, 2012

(30) Foreign Application Priority Data

May 26, 2011 (CA) ..... 2741581

(51) Int. Cl.
*E21B 21/06* (2006.01)
*F04B 23/04* (2006.01)

(52) U.S. Cl.
CPC ..... *F04B 23/04* (2013.01)

(58) Field of Classification Search
CPC ..... F24D 17/00; F24D 12/02; F24D 1/40; F24D 1/145; F24D 8/00; A47J 27/04; F22B 5/00; F22B 1/52; F22B 1/143; F22B 1/26
USPC ..... 122/20 R, 31.1; 126/360.1; 166/57, 166/75.12, 302, 303, 372; 210/513, 175, 210/176, 170.01, 747.1, 774, 800; 175/66, 175/207
See application file for complete search history.

(56) References Cited

U.S. PATENT DOCUMENTS 1,866,015 A 7/1932 Davey
2,284,809 A 6/1942 Dyer
2,431,753 A 12/1947 Holderle
2,432,079 A 12/1947 Albert
2,698,055 A 12/1954 Williams
3,341,081 A 9/1967 King
3,522,843 A 8/1970 New
3,757,745 A * 9/1973 Miller ..... 122/136 R
3,892,276 A 7/1975 Wells
4,003,139 A 1/1977 Van Winkle
4,014,316 A 3/1977 Jones
4,172,445 A 10/1979 Sellers
4,243,528 A * 1/1981 Hubbard et al. ..... 210/104
4,264,826 A 4/1981 Ullmann
4,425,763 A 1/1984 Porta
4,502,535 A 3/1985 Kofahl
4,658,803 A 4/1987 Ball
4,699,719 A 10/1987 Finley
4,728,029 A 3/1988 Griebel
4,928,664 A 5/1990 Nishino
4,978,064 A 12/1990 Steiner
5,098,036 A 3/1992 Brigham
5,222,696 A 6/1993 Brigham
5,226,594 A 7/1993 Swenson (Continued)

FOREIGN PATENT DOCUMENTS

CA 1 183 722 A 9/1981
GB 2 089 022 A 6/1982

*Primary Examiner* — Gregory A Wilson
(74) *Attorney, Agent, or Firm* — Christensen O'Connor Johnson Kindness PLLC

(57) ABSTRACT

A method and apparatus for heating at least one fluid tank that receives production fluid comprising produced oil and a produced liquid from a hydrocarbon producing well. A layer of liquid is provided in the fluid tank that has a higher specific density and a higher thermal conductivity than the produced oil. The layer of liquid at least partially covers a heat trace positioned in the fluid tank. The heat trace transfers heat to the layer of liquid.

14 Claims, 9 Drawing Sheets

(56) References Cited

U.S. PATENT DOCUMENTS

| | | | | |
|---|---|---|---|---|
| 5,323,061 | A | 6/1994 | Immler | |
| 5,577,661 | A | 11/1996 | Puett, Jr. | |
| 5,656,136 | A | 8/1997 | Gayaut | |
| 5,732,764 | A | 3/1998 | Douglas | |
| 5,957,500 | A | 9/1999 | Wade | |
| 5,988,280 | A | 11/1999 | Crawford | |
| 6,032,732 | A | 3/2000 | Yewell | |
| 6,516,754 | B2 | 2/2003 | Chadwick | |
| 6,938,581 | B2 * | 9/2005 | Neeser et al. | 122/20 R |
| 7,703,613 | B2 * | 4/2010 | Haslem | 210/513 |
| 7,726,298 | B2 * | 6/2010 | St. Denis | 126/391.1 |
| 7,841,305 | B2 * | 11/2010 | King et al. | 122/33 |
| 8,176,982 | B2 * | 5/2012 | Gil et al. | 166/272.1 |
| 2002/0166545 | A1 | 11/2002 | Stone | |
| 2004/0173164 | A1 | 9/2004 | Denis | |
| 2007/0012450 | A1 * | 1/2007 | Uttley | 166/302 |
| 2008/0099414 | A1 * | 5/2008 | Haslem | 210/800 |
| 2008/0206699 | A1 * | 8/2008 | St. Denis et al. | 432/62 |
| 2010/0230347 | A1 * | 9/2010 | Haslem | 210/523 |

* cited by examiner

FIG. 1 - PRIOR ART

FIG. 2 - PRIOR ART

FIG. 3 - PRIOR ART

FIG. 4 - PRIOR ART

FIG. 6 - PRIOR ART

FIG. 7 - PRIOR ART

FIG. 8 - PRIOR ART

METHOD AND APPARATUS FOR HEATING A SALES TANK

FIELD

This relates to a method and an apparatus for heating a liquid storage tank, such as a sales tank on a well site.

BACKGROUND

Most producing oil wells within the Provinces of Alberta and Saskatchewan are set up in a similar fashion. A drive head is positioned on a well head. A production flow line extends from the well head to a liquid storage tank, which is spaced a distance from the well head. A propane burner shoots flame into a fire tube in the liquid storage tank. An engine positioned in a wooden shack adjacent to the well head, provides motive force to the drive head. Propane tanks positioned adjacent to the liquid storage tank, provide a fuel source for the propane burner and the engine respectively.

Referring to FIG. 5, there is illustrated a prior art well site, generally indicated by reference numeral 100. Well site 100 includes a liquid storage tank 12 having an interior 14, a peripheral sidewall 16 and a heat tube 17. A primary propane tank 20 provides fuel to a burner 21. A secondary propane tank 23 provides fuel to an engine 24 that is housed separate and apart from liquid storage tank 12. Hydraulic flow lines 26 driven by hydraulic pump 48 extend from engine 24 to drive head 28. A production line 30 extends from a well head 32 to liquid storage tank 12.

U.S. Pat. No. 7,726,298 (St. Denis) entitled "Method and apparatus for heating a liquid storage tank" describes an apparatus for heating a liquid storage tank. Referring to FIG. 1, the apparatus, generally indicated by reference numeral 10, includes a liquid storage tank 12 having an interior 14, a peripheral sidewall 16, and an engine compartment 18 appended to liquid storage tank 12. Referring to FIG. 2, primary propane tank 20 provides fuel through fuel line 22 to engine compartment 18. Referring to FIGS. 1 and 3, an engine 24 is disposed within engine compartment 18. Referring to FIG. 2, hydraulic flow lines 26 extend from engine compartment 18 to drive head 28. A production line 30 extends from well head 32 to liquid storage tank 12. Hydraulic flow lines 26 are in a substantially parallel orientation and in close proximity to production line 30. Referring to FIG. 3, engine 24 has exhaust manifold 34 which is connected to an exhaust conduit 36 which extends from peripheral sidewall 16 into interior 14 of storage tank 12. Exhaust conduit 36 is depicted as a substantially horizontal loop that, upon exiting peripheral sidewall 16, is adapted with a muffler 38. Exhaust conduit 36 is further adapted with interior baffles 40. An engine coolant conduit 42 extends from engine 24. A thermostatically controlled valve 44 is positioned along engine exhaust conduit 36. From thermostatically controlled valve 44, engine coolant conduit 42 extends below exhaust conduit 36. Referring to FIGS. 3 and 4, engine coolant conduit 42 is depicted as being positioned below the exhaust conduit 36 and proceeds horizontally below the exhaust conduit 36 and returns to engine 24. Referring to FIG. 3, in addition, engine coolant conduit 42 may extend to a booster pump 46 that also returns engine coolant to engine 24. Depending upon the orientation of thermostatically controlled valve 44, the flow of heated engine exhaust may proceed by either the coil or by pass route. Engine 24 is further adapted with hydraulic pump 48 that provides hydraulic pressure to hydraulic flow lines 26.

Referring to FIG. 3, engine 24 is operated within engine compartment 18. Referring to FIG. 2, fuel for the operation of engine 24 is provided by propane tank or casing gas. 20. No other source of fuel is needed. The noise of engine 24 is dampened by muffler 38 and absorption of sound by liquid storage tank 12 through peripheral sidewall 16. Heat 50, given off from engine 24 during operation, heats engine compartment 18 and such heat is transferred through peripheral sidewall 16 to interior 14 of liquid storage tank 12. Hot exhaust gases 52 from engine 24 pass through exhaust conduit 36 and heat 50 given off heats interior 14 of liquid storage tank 12. Interior baffles 40 disrupt the linear flow of hot exhaust gases 52 to more evenly distribute and transfer heat from hot exhaust gases 52 through exhaust conduit 36 to interior 14 of liquid storage tank 12. Referring to FIG. 4, in the illustrated embodiment, engine coolant conduit 42 is disposed below the exhaust conduit 36. Heated engine coolant passes through engine coolant conduit 42 such that heat 50 is added to further transmit heat 50 to interior 14 of liquid storage tank 12. Referring to FIG. 3, for operation in warmer conditions, thermostatically controlled valve 44 diverts heated engine exhaust, to the bypass route. Allowing 50% of the engine heat out of the 14 tank interior, the heated engine coolant is cooled and, in turn, moderates the temperature of interior 14 of liquid storage tank 12. Referring to FIGS. 1 and 2, apparatus 10, by configuring hydraulic lines 26 in a substantially parallel orientation and in close proximity to production line 30, production fluid within production line 30 is also heated.

Referring to FIGS. 6 through 8, in some circumstances, the fluids held in liquid storage tank 12 contain suspended solids, or solids are transported with the fluids as they are deposited in liquid storage tank 12, such as sand. As the liquids are stored, the solids settle out and come to rest on the bottom of tank 12. When this is the case, the fluids stored in storage tank 12 can be more effectively heated by raising engine compartment 18 relative to the bottom of liquid storage tank 12, such that at least a portion of the engine compartment is inset within the periphery of the storage tank 12 at a higher position than would otherwise be the case. As it is raised, it may be necessary to include a floor 54 with rails 56, a support 58, and stairs 60 shown in FIG. 7. Referring to FIG. 8, compartment 18 may also have a vent 62, and an engine guard 65 to prevent individuals from entering the compartment during operation.

SUMMARY

According to one aspect there is provided an apparatus for heating at least one fluid tank that receives production fluid comprising produced oil and a liquid from a hydrocarbon producing well. A layer of liquid that has a higher specific density and a higher thermal conductivity than the produced oil is positioned in the at least one fluid tank. A heat trace is positioned within the fluid tank at least partially in the layer of liquid and transfers heat to the layer of liquid to heat the tank.

According to another aspect, a method of heating at least one fluid tank that receives production fluid comprising produced oil and produced liquid from a production tank on a hydrocarbon producing well includes the steps of: providing a heat trace in the fluid tank and providing a layer of produced liquid in the at least one fluid tank which submerges at least a portion of the heat trace and which has a higher specific density and a higher thermal conductivity than the produced oil.

The at least one fluid tank may be at least one sales tank that receives fluid from a production tank. The heating of the sales tank including the steps of transferring oil from the production tank to the at least one sales tank and causing the heat trace to heat the layer of liquid in the sales tank.

The heat trace utilized in the heating apparatus and method may include a coolant heated by an internal combustion engine being circulated through tubing in the layer of liquid. The layer of liquid may comprise primarily of water. The internal combustion engine may also be used to drive a wellhead pump. The production tank may also be heated by the same internal combustion engine.

BRIEF DESCRIPTION OF THE DRAWINGS

These and other features will become more apparent from the following description in which reference is made to the appended drawings, the drawings are for the purpose of illustration only and are not intended to in any way to be limiting to the particular embodiment or embodiments shown, wherein.

DETAILED DESCRIPTION OF THE PREFERRED EMBODIMENT

The apparatus described below is an improvement on the apparatus for heating a sales tank described above with reference to FIGS. 1 through 8. The preferred embodiment, a variation in which heat is more effectively transferred, and in which a sales tank may also be heated, is described below with reference to FIGS. 9 and 10.

Figure 1:
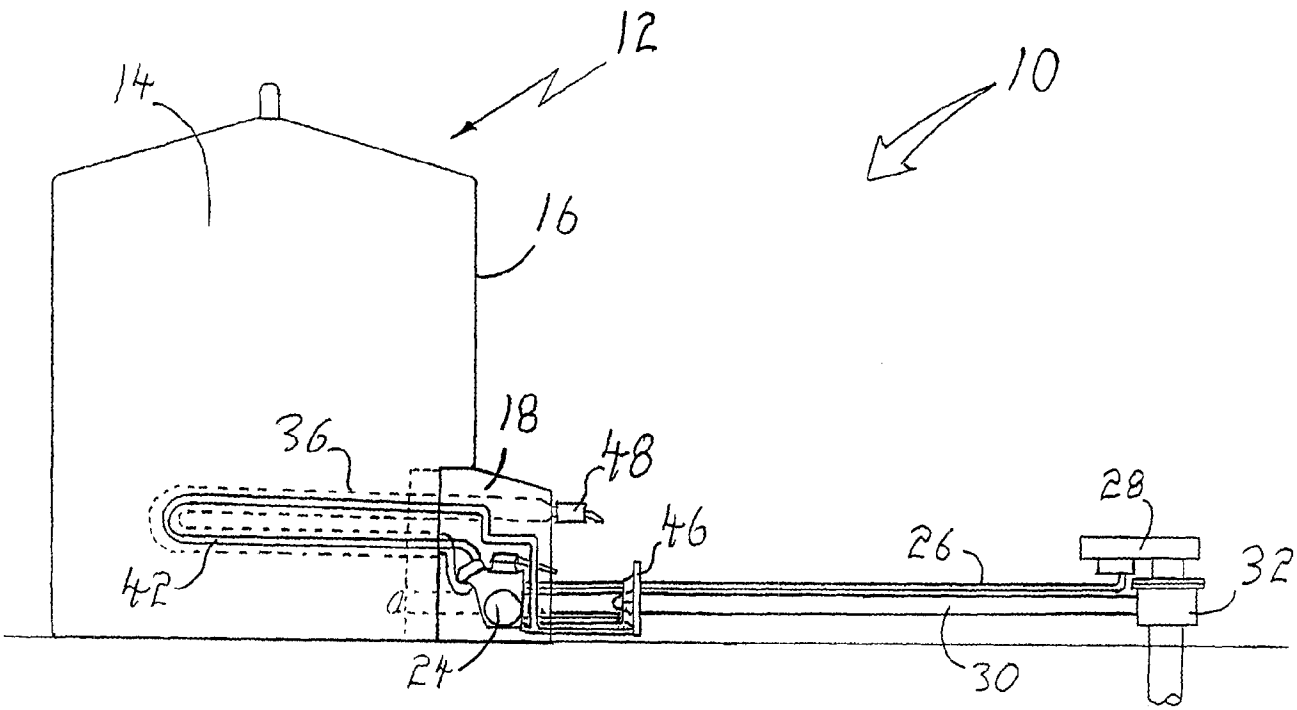
FIG. 1, labelled as PRIOR ART, is a side elevation view of a well site utilizing an apparatus for heating a liquid storage tank.
Figure 2:
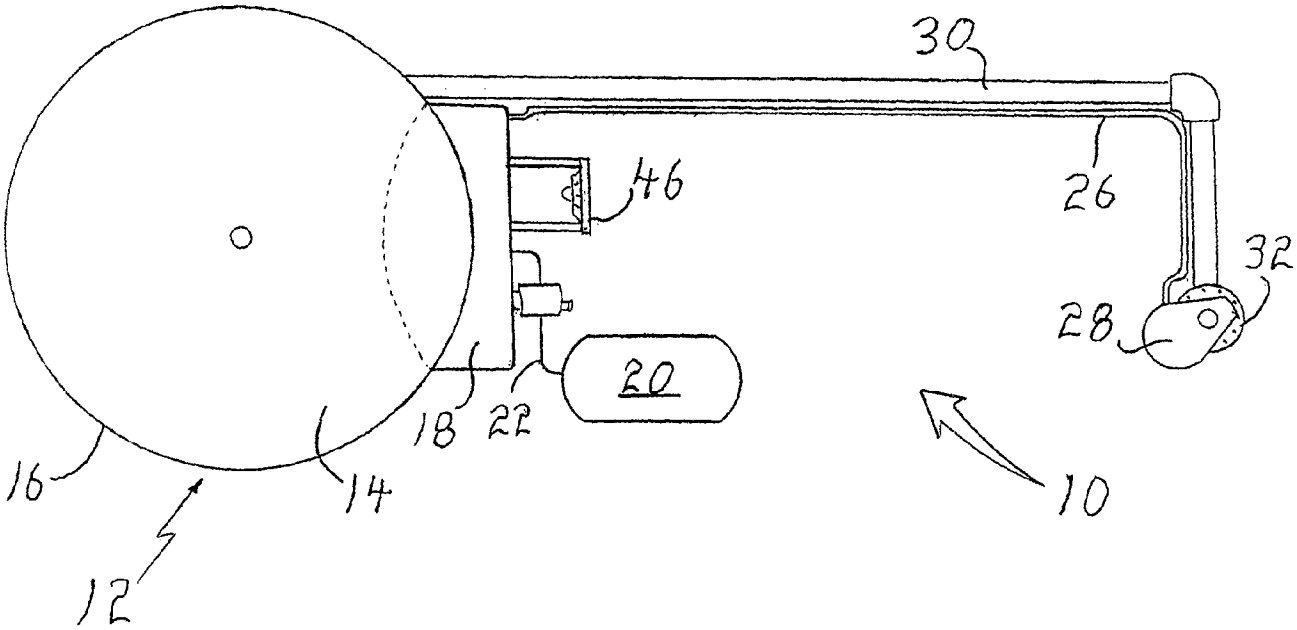
FIG. 2, labelled as PRIOR ART, is a top plan view of the well site utilizing the apparatus illustrated in FIG. 1.
Figure 3:
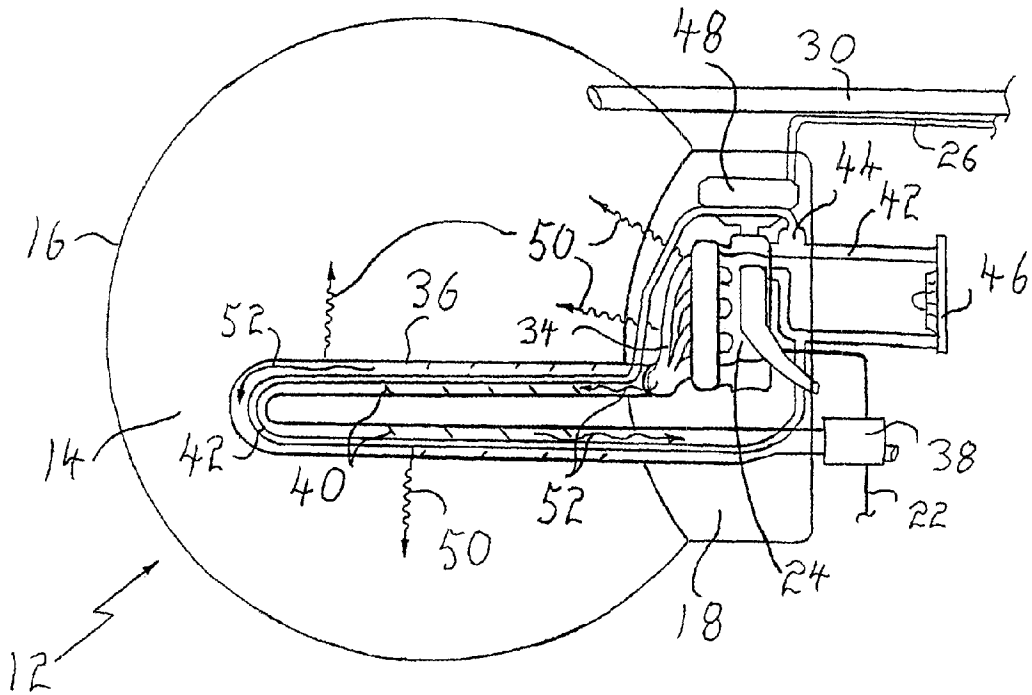
FIG. 3, labelled as PRIOR ART, is a top plan view of the liquid storage tank illustrated in FIG. 1.
Figure 4:
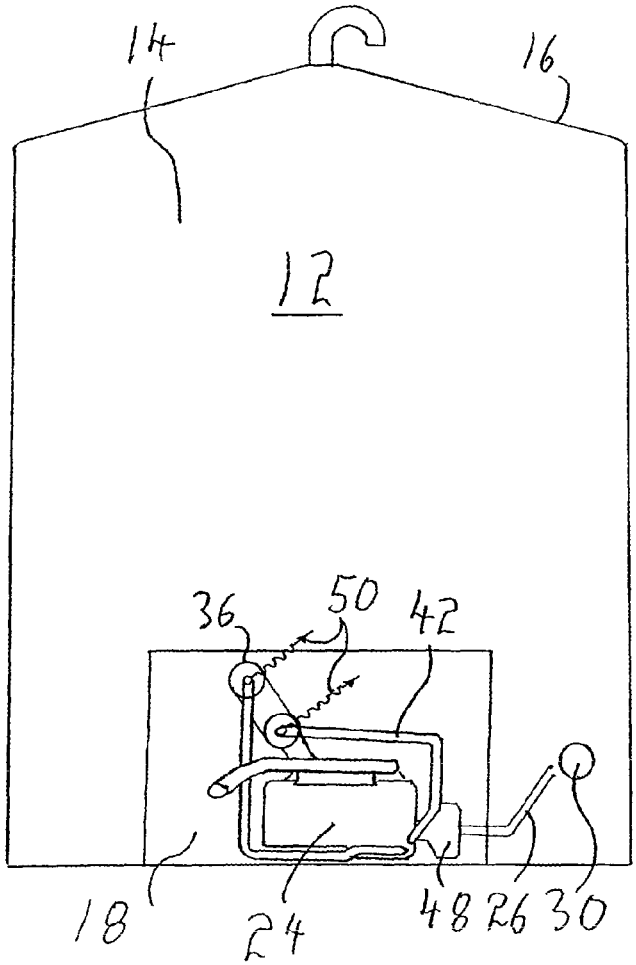
FIG. 4, labelled as PRIOR ART, is a front elevation view of the liquid storage tank illustrated in FIG. 1.
Figure 5:
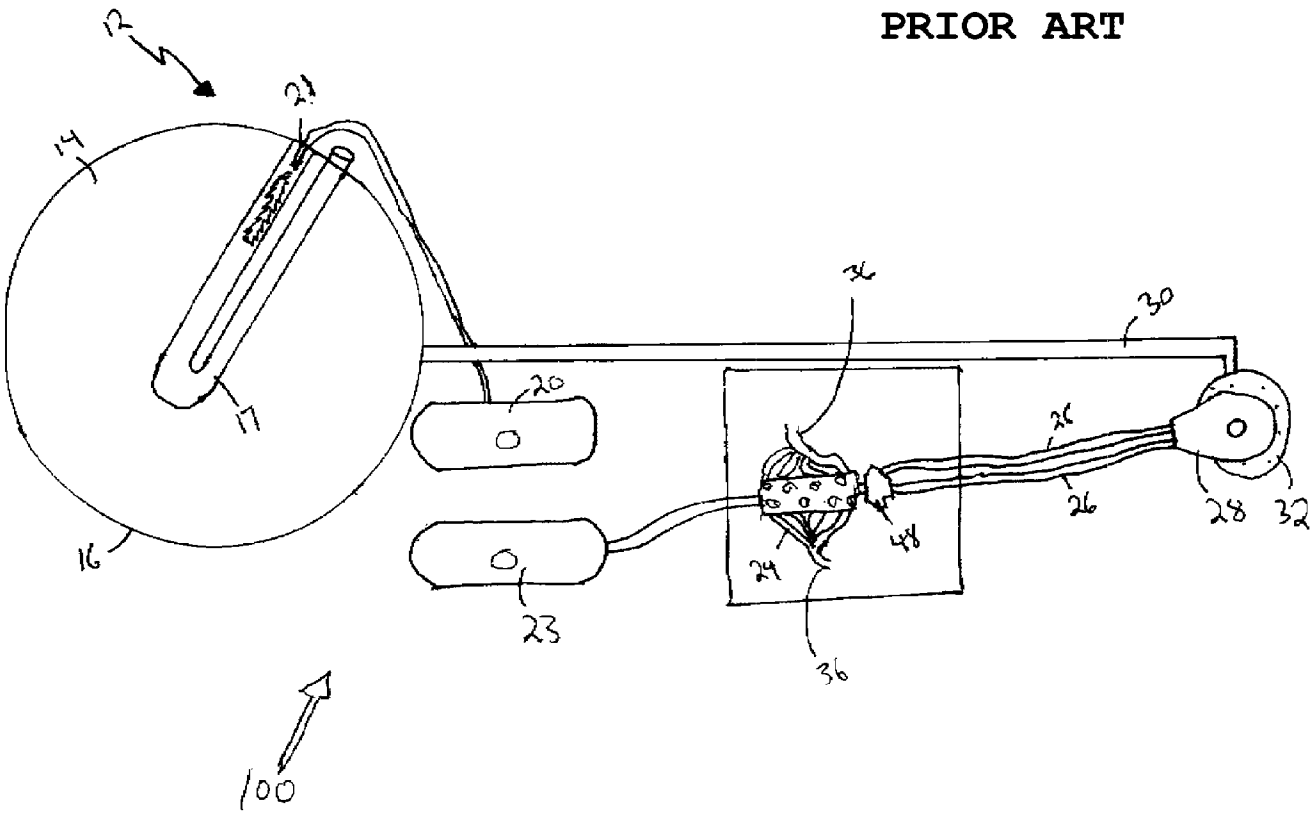
FIG. 5 PRIOR ART
FIG. 5, labelled as PRIOR ART, is a top plan view of a prior art well site.
Figure 6:
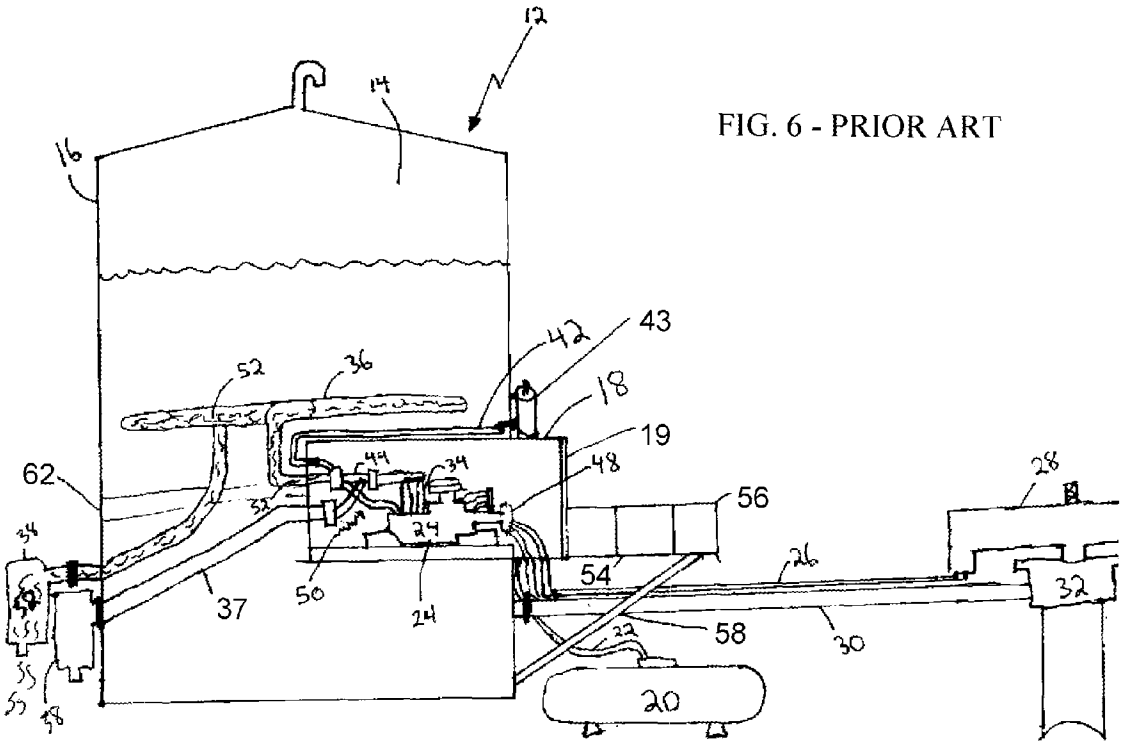
FIG. 6, labelled as PRIOR ART, is a side elevation view of a well site utilizing a variation of the apparatus illustrated in FIG. 1.
Figure 7:
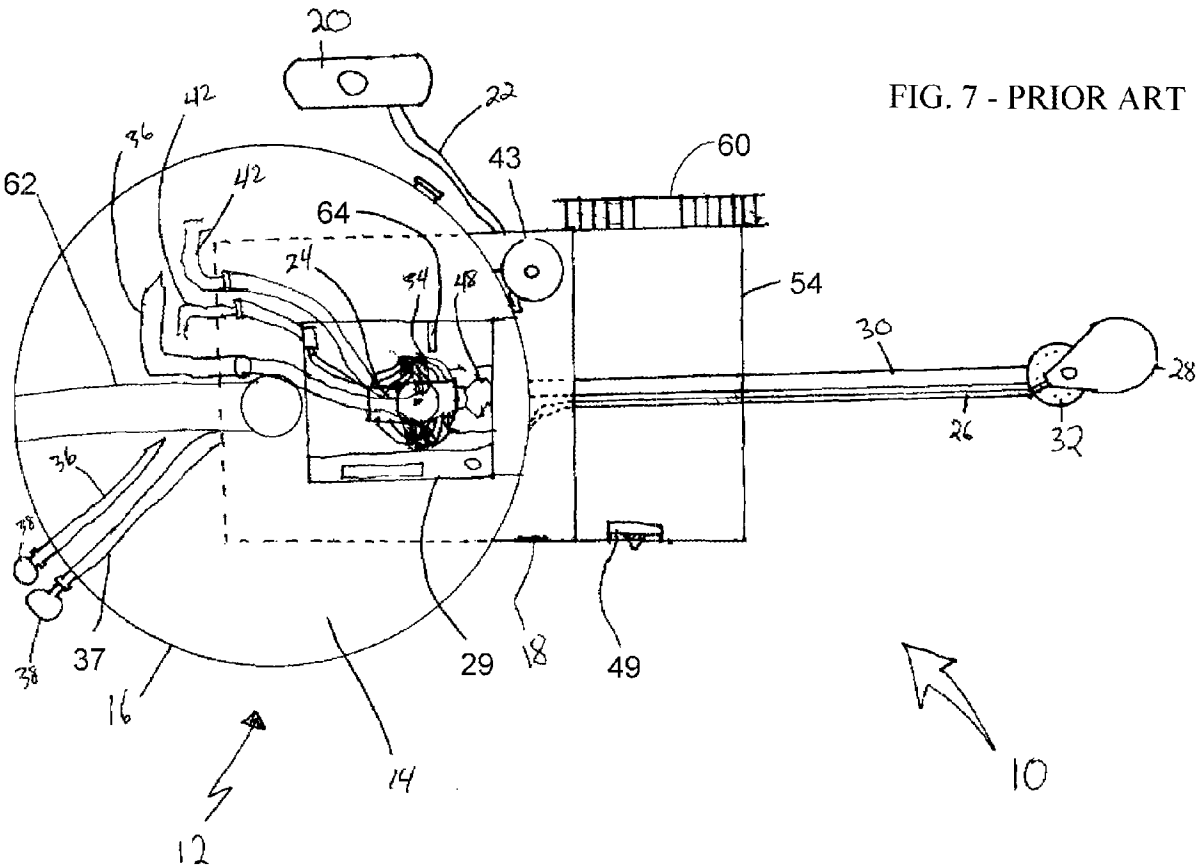
FIG. 7, labelled as PRIOR ART, is a top plan view of the well site using the variation illustrated in FIG. 6.
Figure 8:
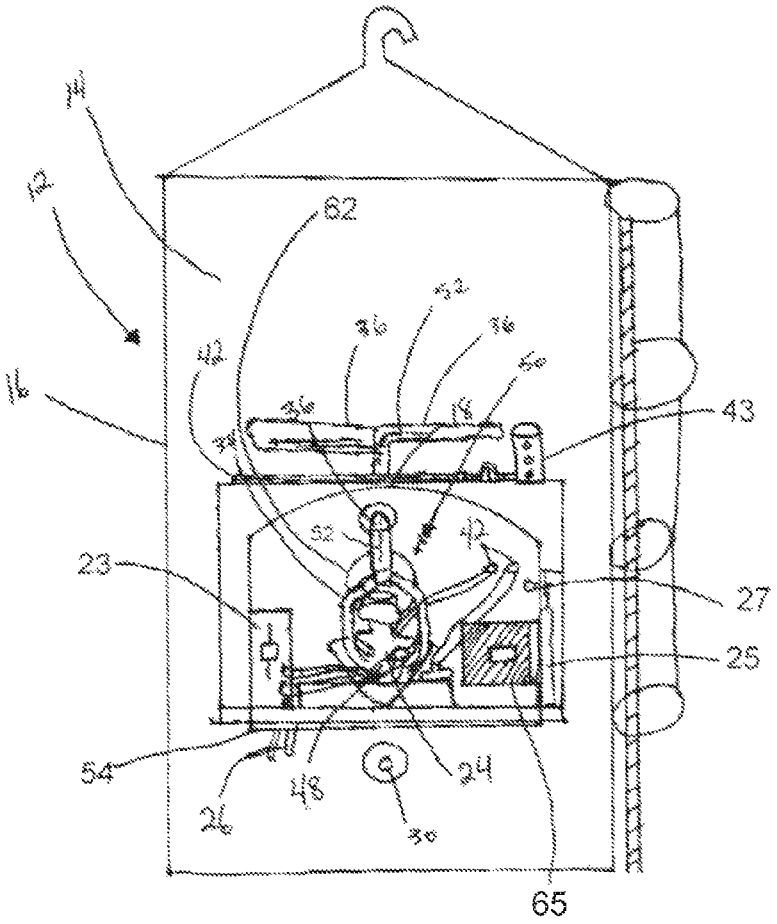
FIG. 8, labelled as PRIOR ART, is a front elevation view of the variation illustrated in FIG. 6.
Figure 9:
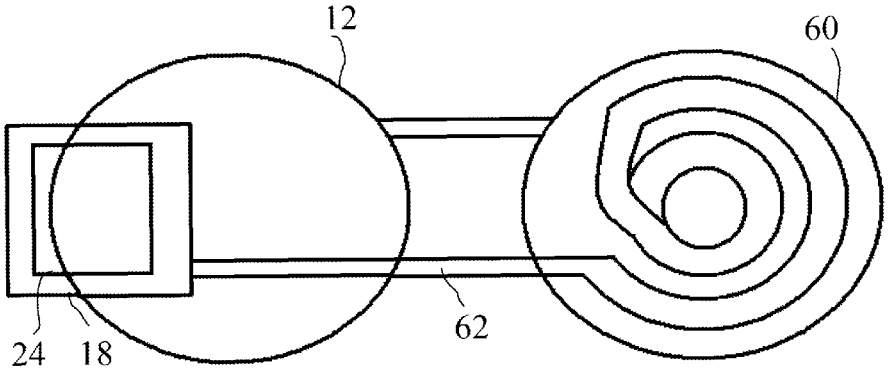
FIG. 9 is a top plan view of the liquid storage tank illustrated in FIG. 1 in fluid communication with a second tank.
Figure 10:
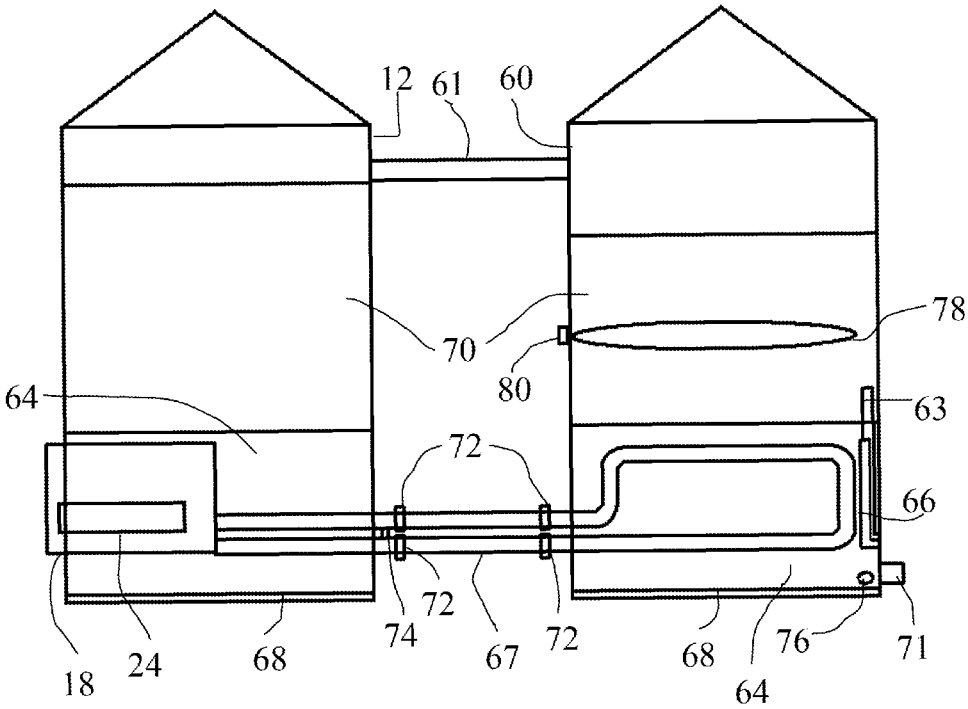
FIG. 10 is a side elevation view of the liquid storage tank and second tank in fluid communication shown in FIG. 9.

Referring to FIGS. 9 and 10 engine 24 may be used to heat a sales tank. In the depicted drawing, sales tank is identified using reference numeral 60 and reference numeral 12 is used to identify a production tank. Generally, the first tank to receive the production fluid is referred to as the "production tank." If a second tank is connected to receive the overflow from the production tank, this is generally referred to as the "sales tank." This terminology is used as the fluid is generally cleaner in the sales tank, having had more time to separate the multiple phases, and when a fluid load is taken from the well site, it is commonly taken from this tank because it is cleaner. However, while only one sales tank 60 is shown, it is not uncommon to have more than one sales tank on a well site, and it will be understood that the techniques described below may be used to heat more than one sales tanks 60, if more than one sales tank is present, and if there is sufficient heat to do so. This will depend on the preferences of the user and the heating requirements compared to the available heat.

Produced oil moves from production tank 12 to sales tank 60 by transfer pipe 61, and is removed from sales tank 60 by a riser 63. In the preferred example depicted in FIGS. 9 and 10, the heat produced by engine 24 is used to heat both production tank 12 and sales tank 60. In this example, production tank 12 is equipped with engine compartment 18 and is heated as described previously, and sales tank 60 is heated using excess heat not required in production tank 12, as described below. However, it will be understood that variations may also be used. For example, production tank 12 may not have an engine compartment 18. Alternatively, only production tank 12 or sales tank 60 may be heated.

Referring to FIGS. 9 and 10, sales tank 60 is connected to receive fluids from production tank 12. Generally speaking, a rough separation of phases occurs in production tank 12, with sand 68 falling to the bottom, and oil 70 floating to the top of the water portion 64. As the oil reaches the height of transfer pipe 61 of production tank 12, oil flows into sales tank 60, which helps improve the quality of fluids that are transported from the well site. As with fluids in the production tank 12, the fluids in sales tank 60 are also generally kept warm. However, the heating requirements in sales tank 60 are not as high, as the fluids were pre-warmed in production tank 12, production and sales tanks 12 and 60 are often insulated, and the temperature does not have to be maintained at as high a temperature as in production tank 12.

Referring to FIG. 10, as shown, a fluid line 67 is positioned within sales tank 60. This fluid line 67 is connected to engine 24, such that heated engine coolant, such as glycol, is circulated through fluid line 67. Fluid line 67 has isolation valves 72 positioned at points along fluid line 67 to alter the course of heated engine coolant by either allowing it to flow through fluid line 67 or forcing heated engine coolant through a bypass 74 to prevent it from being used to heat sales tank 60. It will be apparent that other methods of heating the fluid in fluid line 67 may also be used. For example, fluid line 67 may circulate a heat transfer fluid in a closed circuit that is heated in a heat exchanger connected to engine 24. In addition, there may be separate fluid circuits for tanks 12 and 60, where one or both is heated using a heat exchanger.

To assist in the transfer of heat to the fluid in either production tank 12 or sales tank 60, a layer of liquid 64 is positioned below the oil layer 70, such that at least a portion of fluid line 67, and preferably all of fluid line 67, is submerged within layer of liquid 64. Layer of liquid 64 is maintained at the height required to ensure a sufficient portion of fluid line 67 is submerged. In sales tank 60, engine compartment 18 is preferably also submerged within layer of liquid 64. Layer of liquid 64 has a higher density than the oil expected to be produced from the well, and has a higher thermal conductivity than the oil as well. Layer of liquid 64 is maintained at a level to ensure that a sufficient portion of fluid line 67 is kept submerged. In one example, a depth of five feet at the bottom of sales tank 60 is found to be sufficient. Other depths may be used depending on the preferences and requirements of the user, and the tank specifications. The appropriate level is maintained by providing a riser pipe 66 used to draw off water that extends to the desired height, which prevents drawing layer of liquid 64 down below the desired height accidentally. Another riser pipe 63 extends above riser pipe 66 and is used to withdraw oil from oil layer 70. The valves 71 for riser pipes 63 and 66 are preferably located conveniently at a bottom of the tank, such as in an ENVIROVAULT™. While not shown, similar standing pipes and valves are preferably provided on sales tank 12 as well. Tank 60 is also shown with a sand removal port 76 that is used to remove sand 68 from the bottom of tank 60.

Fluid line 67 is preferably made from coil tubing with a 1" to 2" diameter. Preferably a minimum of 50 feet of tubing is maintained within layer of liquid 64. The minimum length may also be 100 feet, 150 feet, 200 feet, or more. The minimum length of coil tubing that is kept submerged will depend on the size of the tubing and the heating requirements in the tank. In one example that provided adequate results, 200 feet of 1" tubing was kept in layer of liquid 64.

In the event that the heat from engine 24 is insufficient to maintain the desired temperature, other sources of heat may be provided. For example, an additional heat source may be provided within the tank. Referring to FIG. 10, an electric coil 78 may be positioned within oil layer 70 as shown, or within liquid layer 64. Electric coil 78 is preferably equipped with a thermostat 80 that activates electric coil 78 in the event that heated engine coolant flowing through fluid line 67 is not sufficient to maintain an appropriate temperature of oil 70. Electric coil 78 may be powered by an on-site power source, such as a generator, or by an alternator connected to engine 24. Alternatively, an external heat source (not shown) may be provided that heats the fluid in liquid line 62 before it passes into the relevant tank.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. In combination:

a production tank containing production fluid comprising oil and water produced from a hydrocarbon producing well; and a sales tank, the sales tank comprising:

an overflow pipe connected between the sales tank and the production tank, the overflow pipe transferring the oil from the production tank to the sales tank as the production tank is filled;

a layer of liquid that is separate and distinct from the oil, the liquid having a higher specific density and a higher thermal conductivity than the oil, the layer of liquid being maintained above a minimum level; and a heat trace positioned at least partially below the minimum level of the layer of liquid such that at least a portion of the heat trace is submerged in the layer of liquid, the heat trace transferring heat to the layer of liquid.

2. The combination of claim 1, wherein the liquid is water.

3. The combination of claim 1, wherein the production tank receives production fluid directly from the hydrocarbon producing well.

4. The combination of claim 1, wherein the heat trace comprises a heat transfer fluid that is heated by heat from an internal combustion engine.

5. The combination of claim 4, wherein the internal combustion engine is used to drive a wellhead pump.

6. The combination of claim 4, wherein the production tank is heated by heat generated by the internal combustion engine.

7. The combination of claim 1, wherein the heat trace is entirely submerged in the layer of liquid.

8. A method of heating at least one fluid tank that receives oil from a production tank on a hydrocarbon producing well, the method comprising the steps of:

providing a heat trace in the fluid tank;

providing a layer of liquid in the at least one fluid tank that is separate and distinct from the oil, the liquid having a higher specific density and a higher thermal conductivity than the oil;

maintaining the layer of liquid above a minimum level at which at least a portion of the heat trace is submerged;

transferring oil from the production tank to the at least one fluid tank through an overflow pipe; and causing the heat trace to heat the layer of liquid.

9. The method of claim 8, wherein the at least one fluid tank is a sales tank.

10. The method of claim 8, wherein the liquid comprises water.

11. The method of claim 8, wherein causing the heat trace to heat the layer of liquid comprises heating a heat transfer fluid using heat from an internal combustion engine.

12. The method of claim 11, wherein the internal combustion engine is used to drive a wellhead pump.

13. The method of claim 11, further comprising the step of heating the production tank using heat generated by the internal combustion engine.

14. The method of claim 8, wherein the heat trace is entirely submerged in the layer of liquid.

* * * * *